United States Patent [19]

Bridwell et al.

[11] 4,204,494

[45] May 27, 1980

[54] BOAT WASHING APPARATUS

[75] Inventors: Glenn D. Bridwell, Portage; James Maule, Michigan City; Alois Schrombeck, Lowell; Willis Wognum, Crown Point, all of Ind.

[73] Assignee: WSBM Company, Inc., Portage, Ind.

[21] Appl. No.: 838,674

[22] Filed: Oct. 3, 1977

[51] Int. Cl.[2] ..... B63B 59/00

[52] U.S. Cl. ..... 114/222; 15/21 R

[58] Field of Search ..... 114/222; 15/21 R, 21 D, 15/53 R, 53 A, 53 AB, DIG. 2

[56] References Cited

U.S. PATENT DOCUMENTS

| | | | |
|---|---|---|---|
| 3,227,124 | 1/1966 | Campbell | 114/222 |
| 3,561,391 | 2/1971 | Locati | 114/222 |
| 3,773,059 | 11/1973 | Arneson | 114/222 |
| 3,939,521 | 2/1976 | Clark | 15/53 AB |
| 4,030,440 | 6/1977 | Wickersham | 114/222 |

*Primary Examiner*—Trygve M. Blix
*Assistant Examiner*—Jesus D. Sotelo
*Attorney, Agent, or Firm*—Oltsch, Knoblock & Hall

[57] ABSTRACT

A boat washing apparatus having a stationary frame to which are pivoted a pair of carrier frames which journal rotary power driven brushes across which may be moved an elevated boat mounted on a mobile support.

4 Claims, 4 Drawing Figures

BOAT WASHING APPARATUS

SUMMARY OF THE INVENTION

Small boats and pleasure craft used in inland waters in climates in which the water is subject to freezing are commonly stored during winter weather in storage buildings at marinas. The storage buildings are commonly provided with racks or supports which accommodate storage of boats in multiple tiers, that is, one above another, as a measure of conserving space and accommodating storage of largest number of boats possible within a building of a given size. The boats are commonly moved between dock or launching ramp locations and storage buildings by mobile means, such as fork lift trucks having adequate power to elevate heavy boats and having long fork lift arms capable of supporting and carrying boats of lengths of 30 feet or more and having arm carrying means which can be adjusted to provide selected spacings between fork arms so as to accommodate support of boats of different widths or at different positions of a boat.

Boats commonly collect or accumulate algae and other material, such as slime or dirt, during a boating season. This may be removed by washing or cleaning prior to storage to ensure that dirty water from a boat in an upper tier being stored will not drip upon the next boat therebelow in storage. Also, racing craft or speed craft on whose hull dirt has accumulated are often washed prior to use to ensure optimum speed and minimize the possibility that matter collected on the hull of a boat will reduce the speed of the boat.

The manual washing of a boat hull is a time consuming and laborious task. Various devices have been designed to mechanize the boat washing operation and such prior devices have met with limited acceptance or have proven to have limited utility in many instances. Most prior devices, such as those shown in U.S. Pat. No. 2,327,012, dated Aug. 17, 1943; U.S. Pat. No. 3,227,124, dated Jan. 4, 1966; and U.S. Pat. No. 3,709,184, dated Jan. 9, 1973 entail various types of apparatus which is submerged so as to clean the hull of a boat which is afloat. Apparatus of this character can be used in inland waters subject to freezing only during temperatures above freezing and must be dismantled and removed from submerged position before each freezing season and must be reinstalled each spring after the freezing season.

It is the primary object of this invention to provide a boat washing apparatus which can be installed and maintained ashore and which will function to quickly and effectively wash and clean the hull of a boat.

A further object is to provide an apparatus of this character which mounts cleaning elements which automatically adjust to accommodate the contour of the hull of a boat being washed thereby as the boat is shifted or moved endwise relative to the washing apparatus.

Other objects will be apparent from the following specification.

DESCRIPTION OF THE PREFERRED EMBODIMENT

Figure 1:
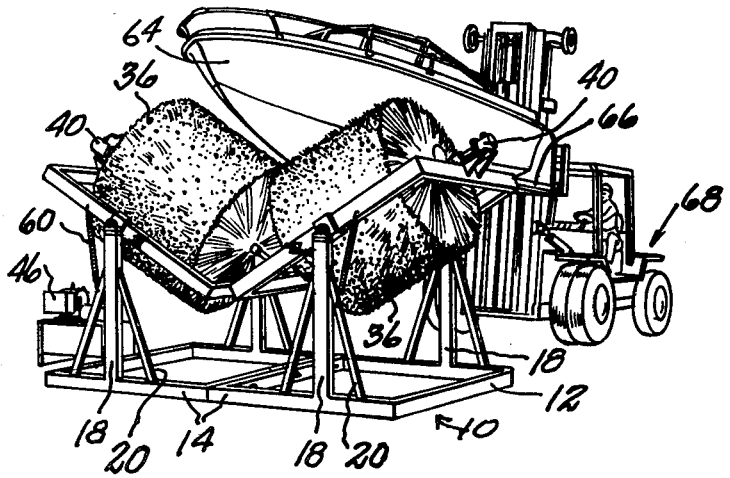
FIG. 1 is a perspective view of the apparatus being used to clean the hull of a boat.

The apparatus has a frame which is anchored to the ground or to a pavement in fixed position adjacent a boat ramp at a marina. The frame has two similar sections arranged side by side, in each of which is pivoted a brush carrier. The pivot axes of the carriers are substantially parallel and each, in turn, journals the shaft of a rotary power driven brush on an axis perpendicular to the pivot axis of the brush carrier. Resilient means urge the brush carriers to substantially horizontal juxtaposed position. Each carrier is provided with means to limit the extent to which it can pivot. The brushes are positioned end to end in close spaced relation in normal or idle position by the springs and are provided with bristles of substantial length extending radially from the brush shaft which is provided with power driven rotating means. Any suitable means is provided to discharge water for use in the washing operation, said means preferably constituting small openings in a hollow brush shaft through which jets of water under pressure are ejected along the length of the brush shaft in radial directions. A boat to be washed is carried by a fork lift truck or by slings suspended from a crane or other mobile carrier, and is advanced into contact with the brushes so as to be equally engaged thereby, as at opposite sides by the brushes which contact the hull. The brushes follow variations in the contour of the boat hull as it is advanced endwise across the brushes by the boat carrier.

Referring to the drawings which illustrate a preferred embodiment of the invention, the numeral 10 designates a frame which preferably is formed of two similar sections. Each frame section includes a base consisting of end members 12 and transverse members 14 formed of rigid structural members. The frame is adapted to be anchored in fixed position upon the ground or upon a pavement (not shown) by securing means (not shown). The adjacent end members 12 are preferably secured together by securing means 16. Each transverse member 14 of each section of the frame mounts, intermediate its ends, a vertical rigid structure including an upright 18 and brace or strut members 20. At its upper end, each upright 18 mounts a bearing or journal 22. Bearings 22 are axially aligned and journal aligned shafts 24 projecting from substantially parallel members 26 of a rigid carrier which is substantially rectangular and includes connecting end members 28. Each of the end carrier members 28 mounts centrally thereof a journal 30 for a rotatable shaft 32. Shaft 32 preferably is hollow and is provided with a plurality of openings, substantially equally spaced lengthwise and extending in different radial directions, from which liquid may be jetted. The liquid jetting means 34 may constitute small apertures in the shaft or jet nozzles mounted at shaft openings. Shaft 32 mounts brush bristles 36 of substantial length which extend radially and uniformly from the shaft 32 to define a substantially cylindrical brush of a length and diameter having slight clearance in the carrier 26–28.

Figure 2:
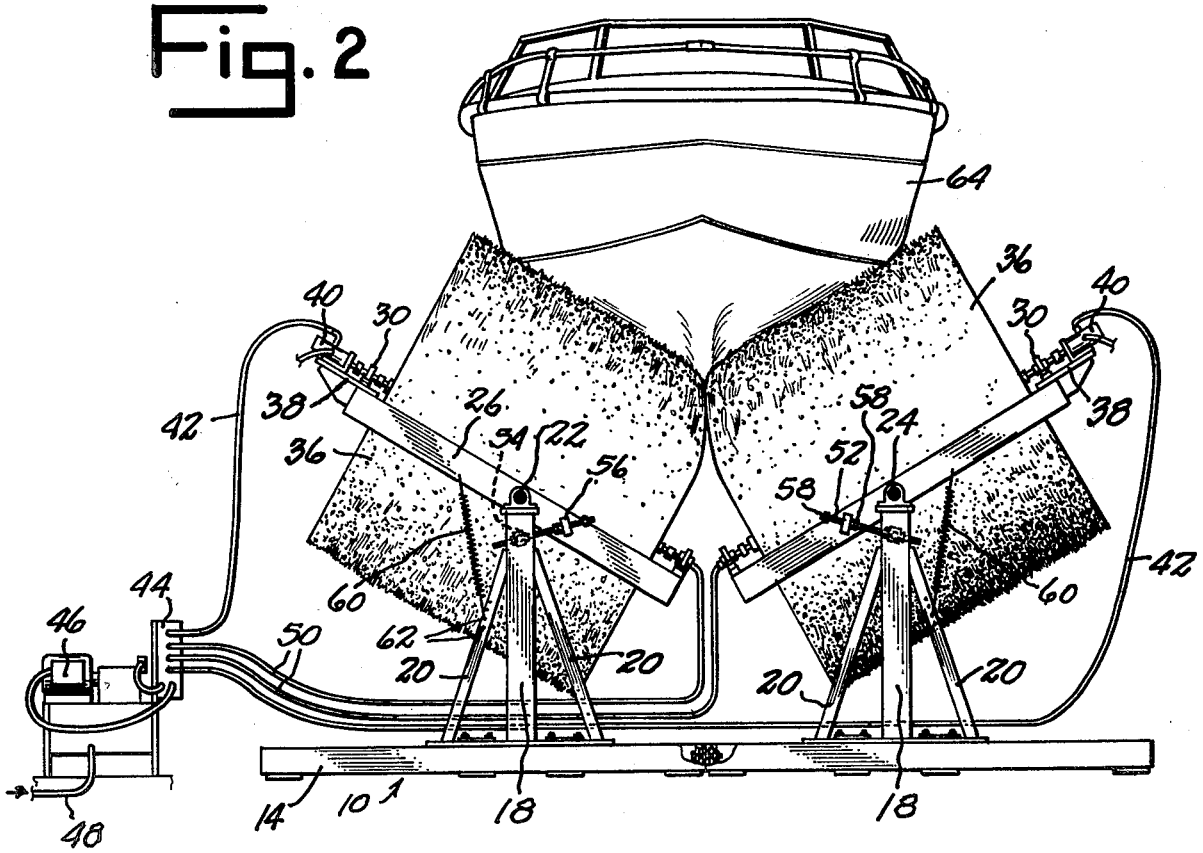
FIG. 2 is a front elevational view illustrating the use of the apparatus to wash a boat.
Figure 3:
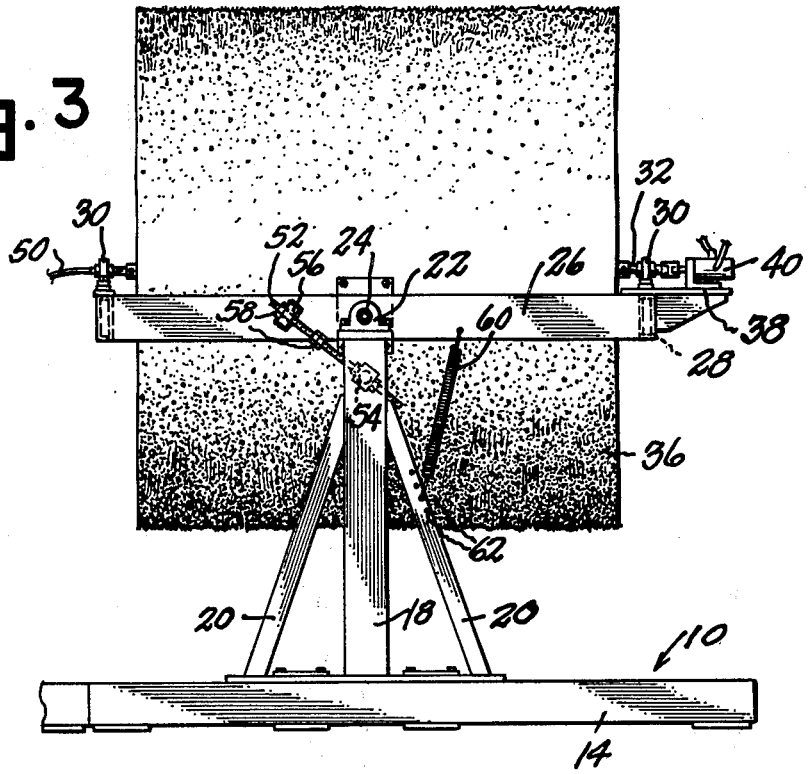
FIG. 3 is a front elevational view of one section of the apparatus.
Figure 4:
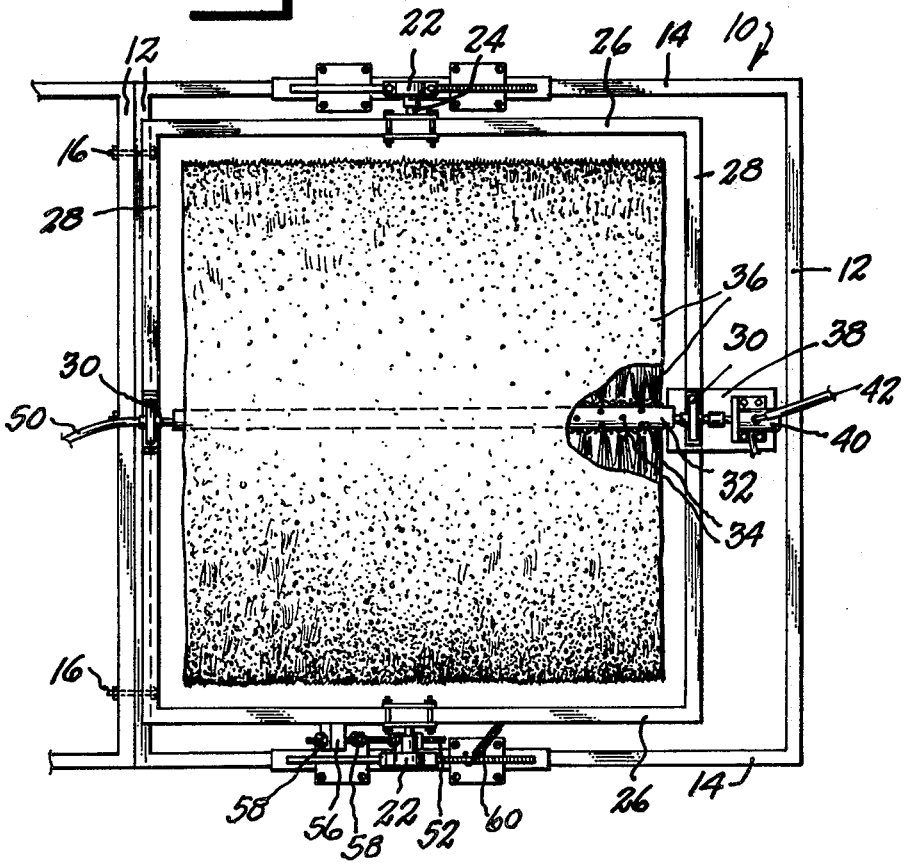
FIG. 4 is a top plan view of one section of the apparatus.

One end member 28 of each carrier, preferably the outermost end member as shown, mounts centrally thereof a supporting unit including a plate 38 upon which may be mounted a motor 40 having a driving connection with shaft 32. In one embodiment of the invention, the motor 40 is of the hydraulic type having connection by hydraulic line 42 with a manifold 44 which in turn is connected with a pump 46 having an inlet conduit or hose 48 which may extend into a lake, river or other body of water from which the boat which is to be cleaned has been removed. The lines 42 are flexible hoses which will accommodate shifting of the carriers between the horizontal position as seen in FIG. 3 and a tilted position as seen in FIG. 2. A pair of flexible hydraulic lines or hoses 50 also project from the manifold 44, as to the ends of the hollow shafts 32 opposite the ends connected with the motors 40. Each line or hose 50 is provided with a suitable outlet means (not shown) for discharging water under pressure into a hollow shaft. If desired, the lines 50 may discharge at nozzles (not shown) directed at the hull of a boat engaged by the upper portion of the brushes.

Any suitable means for limiting the tilting of the brush carriers, as between a horizontal position as shown in FIG. 3 and a predetermined tilted position as seen in FIGS. 1 and 2, may be provided. As here shown, the tilt limiting means comprises an elongated screw threaded member 52 adjustably positioned or mounted within the screw threaded bore of a member 54 rotatably mounted upon an upright 18 of each section of the frame at a point spaced below the upper end of the upright and the bearing 22. A bushing or guide 56 is rotatably mounted upon a member 26 of each carrier spaced from the upright 18 and the bushing 22 and slidably receives a portion of the screw member 52. A pair of stop nuts 58 are adjustably carried by screw member 52 in spaced relation at opposite sides of the rotatable guide bushing 56. By this construction, the extent to which each carrier is free to pivot can be regulated or adjusted easily and quickly, as between a position as illustrated in FIG. 3 in which the carrier is substantially horizontal as urged by a tension spring 60 and a predetermined tilted position. Spring 60 is preferably a coil spring connected to carrier frame member 26 in spaced relation to the bearing 22 and at the side of the carrier opposite that at which the guide bushing 56 is mounted. The opposite end of the coil spring 60 may have anchorage at any of a plurality of frame support openings 62 formed either in the upright 18 or in a brace 20 as illustrated. Thus, tilting of the carrier from the horizontal position of FIG. 3 as determined by the setting of one stop nut 58 and an inclined position, for example as illustrated in FIG. 2 as determined by the positioning of the opposite stop nut 58, is readily accommodated by the extension of the coil spring 60.

The use of the device to clean the hull of a boat is illustrated in FIGS. 1 and 2 wherein the boat 64 is illustrated as supported in an elevated position, as upon the arms 66 of a fork lift truck 68. The truck 68 will preferably be of the type which accommodates adjustment of the spacing between a pair of fork lift arms 66 and the fork arms thereof are of sufficient length to support a boat thereon at a selected elevation, as between a low level to pass under the hull of the boat while it is afloat at a boat ramp and an elevation sufficiently high to permit delivery of a boat into and removal of a boat from the top most storage space in a multi-tier storage rack. The use of a fork lift truck is illustrative only. It will be understood that any type of truck adapted to carry a boat, as by means of slings, may be utilized for the purpose of removing a boat from and returning a boat to the water, delivering it to and passing it through the cleaning apparatus and delivering it to and removing it from a multi-tier storage rack.

The use of the apparatus entails the delivery of a boat to be cleaned from a pickup station or launching ramp to the cleaning apparatus. The elevation at which the boat is supported upon its mobile carrier or truck for delivery to the cleaning apparatus is preferably such that the lowermost point of the hull will be at an elevation higher than the horizontal position of the brush carrier. The hull will be aligned with the space between the adjacent brushes. Then, while the brushes are rotated by the motors 40 and are supplied with liquid from the lines 50, the boat is advanced endwise into contact with the brushes 36, causing the brushes to assume a tilted position as illustrated in FIGS. 1 and 2 in which they effectively clean the boat hull as it is advanced and retracted relative to the brushes. A single pass of the boat relative to the device normally will be sufficient to clean it except at points at which the supporting means such as the fork lift arms or slings contact the boat. Thus, after one passage of a boat fore and aft through the device, the mobile carrier may be withdrawn to a position clear of the cleaning apparatus so the boat may be lowered to the ground or to a support. The boat supporting means, such as fork lift arms or slings, may then be adjusted to engage the boat at new positions when the boat is next elevated and again passed through the cleaning apparatus. This procedure can be accomplished in a few minutes, whereupon a boat withdrawn from the water may be delivered to the storage position. It will be understood that soap or cleaning fluid may be supplied, as at manifold 44, to liquid in lines 50.

While the preferred embodiment of the invention has been illustrated and described, it will be understood that changes in the construction may be made within the scope of the appended claims without departing from the spirit of the invention.

What we claim is:

1. A boat washing apparatus comprising a rigid frame, a pair of juxtaposed brush carriers pivoted to said frame on spaced substantially parallel axis, and normally substantially horizontally positioned, a cylindrical brush journaled in each carrier on an axis substantially perpendicular to the pivot axis of said carrier, and normally substantially horizontally positioned and substantially axially aligned with the brush journaled in the other carrier, means for limiting pivoting of said carriers, and means for rotating each brush, said carrier pivot limiting means being adjustable.

2. A boat washing apparatus comprising a rigid frame, a pair of juxtaposed brush carriers pivoted to said frame on spaced substantially parallel axes, and normally substantially horizontally positioned, a cylindrical brush journaled in each carrier on an axis substantially perpendicular to the pivot axis of said carrier, and normally substantially horizontally positioned and substantially axially aligned with the brush journaled in the other carrier, means for limiting pivoting of said carriers, and means for rotating each brush, means for discharging liquid onto each brush as it rotates, each cylindrical brush including a hollow shaft journaled in said frame and having a plurality of liquid discharge outlets spaced longitudinally and radially thereof, said liquid discharge means discharging liquid into said hollow shaft.

3. A boat washing apparatus comprising a rigid frame, a pair of juxtaposed brush carriers pivoted to said frame on spaced substantially parallel axes, and normally substantially horizontally positioned, a cylindrical brush journaled in each carrier on an axis substantially perpendicular to the pivot axis of said carrier, and normally substantially horizontally positioned and substantially axially aligned with the brush journaled in the other carrier, means for limiting pivoting of said carriers, and means for rotating each brush said frame including a base adapted to be anchored in a fixed position and complementary spaced pairs of parts projecting upwardly from said base, said carriers being pivoted to said upwardly projecting parts.

4. A boat washing apparatus as defined in claim 3, wherein said frame includes a base and two pairs of complementary upwardly projecting parts, said carriers being pivoted to said upwardly projecting frame parts and constituting endless rigid units within which said brushes are positioned.

* * * * *